US006017211A

United States Patent [19]

Gort et al.

[11] Patent Number: 6,017,211

[45] Date of Patent: Jan. 25, 2000

[54] ROTATABLE GAS BURNER SYSTEM FOR A RANGE OR COOKTOP

[75] Inventors: Thomas L. Gort, Tipp City, Ohio; Carlos R. Tejada Medina, San Luis Potosi, Mexico; Guillermo José Aguirre, San Luis Potosi, Mexico; Jorge Luis Pérez, San Luis Potosi, Mexico; Marcos Leyva, San Luis Potosi, Mexico

[73] Assignee: Whirlpool Corporation, Benton Harbor, Mich.

[21] Appl. No.: 09/344,869

[22] Filed: Jun. 28, 1999

[51] Int. Cl.[7] ..... F23Q 3/00

[52] U.S. Cl. ..... 431/266; 431/264; 126/39 R; 126/39 E; 126/39 L

[58] Field of Search ..... 126/39 R, 39 B, 126/39 E, 39 N, 41 A, 39 L, 211; 431/266, 264, 265, 258

[56] References Cited

U.S. PATENT DOCUMENTS

| | | | |
|---|---|---|---|
| 3,938,687 | 2/1976 | Monteil | 126/39 R |
| 4,386,385 | 5/1983 | Hamilton | 361/253 |
| 4,626,196 | 12/1986 | Stohrer, Jr. | 431/264 |
| 4,781,170 | 11/1988 | Perl | 126/39 |
| 4,805,587 | 2/1989 | Schweitzer | 126/39 L |
| 5,149,262 | 9/1992 | Riehl | 431/258 |
| 5,160,256 | 11/1992 | Riehl | 431/266 |
| 5,492,469 | 2/1996 | Oda et al. | 431/266 |

FOREIGN PATENT DOCUMENTS

| | | | |
|---|---|---|---|
| 2138256 | 2/1973 | Germany | 126/39 E |
| 12974 | 1/1979 | Japan | 126/39 B |

OTHER PUBLICATIONS

Appliance Manufacturer, Apr. 1998, Article "From Platforms to Global Niches" Page No. 72, col. 1, Double Face Burner System.

*Primary Examiner*—James C. Yeung
*Attorney, Agent, or Firm*—Joel M. Van Winkle; Robert O. Rice; Thomas J. Roth

[57] ABSTRACT

A surface cooking appliance having a unique rotatable burner. The surface cooking appliance includes a top surface having a first opening and wherein a gas supply tube is provided having a terminal end adjacent the first opening. An igniter is mounted to the top surface adjacent the first opening. A burner is supported on the top surface above the first opening. The burner includes an inlet port, off-set from the center point of the burner, for receiving gas from the gas supply tube. The burner further includes at least two igniter openings for receiving the igniter such that the burner may be rotated about the terminal end of the gas supply tube and positioned in a plurality of positions wherein the igniter is disposed in one of the at least two openings. The surface cooking applicance may further be provided with two rotatable burners constructed as described above such that when the burners are in a first position they can be operated individually and in a second position they can be operated together to heat an elongated pan.

12 Claims, 4 Drawing Sheets

ROTATABLE GAS BURNER SYSTEM FOR A RANGE OR COOKTOP

BACKGROUND OF THE INVENTION

1. Field of the Invention

This invention relates to a rotatable burner system for a gas range or cooktop and more particularly to a burner which may be rotated 180° about an axis offset from the center axis.

2. Description of the Related Art

Gas ranges or cooktops are frequently provided with a plurality of burners for heating items for cooking food. A typical arrangement for a cooktop surface is shown in FIG. 1. In this arrangement, a top cooking surface 10 supports a plurality of burners 12. These burners may be arranged in any of a plurality of configurations but are often arranged as shown in FIG. 1. As can be understood, pots or pans containing food items may be placed above the burners for heating food items therein.

Typically, burners provide a generally circular heat source. Circular burners are well suited to heat generally circular pots and pans. However, in some cases, it is desirable to heat foodstuffs on an elongated cooking pan, such as a griddle. The conventional burner arrangement, such as shown in FIG. 1, is not well suited to provide heat to griddles and other elongated cooking pans since only one portion of the griddle can be heated by the burner. To address this problem, some cooktops have a pair of burners arranged relatively close to each other such as shown in FIG. 2. In this arrangement, a pair of burners 14 are positioned close to each other such that a griddle or other elongated pan can be positioned above two burners. In this manner, the griddle can be effectively and evenly heated along its entire length.

The disadvantage of having two burners positioned relatively close to each other is that they are not readily used individually. As a result, the paired burners are not very functional when they are not being used to heat elongated pans or griddles. One solution to this problem may be to employ movable burners. A cooktop or hob design shown in the publication Appliance Manufacturer dated April 1998, page 72, discloses the concept of providing two elliptical burners that can be rotated 90° and used individually or together.

SUMMARY OF THE INVENTION

The present invention is directed to a surface cooking appliance having a unique rotatable burner. The surface cooking appliance includes a top surface having an opening wherein a gas supply tube is provided having a terminal end. An igniter is mounted to the top surface adjacent the first opening. A burner is supported on the top surface above the first opening. The burner includes an inlet port, off-set from the center point of the burner, for receiving gas from the gas supply tube. The burner further includes at least two igniter openings for receiving the igniter such that the burner may be rotated about the terminal end of the gas supply tube and positioned in a plurality of positions wherein the igniter is disposed in one of the at least two openings.

The present invention is further directed to a surface cooking appliance having at least two rotatable burners. The surface cooking appliance includes a top surface having a first opening and a second opening. A first gas supply tube is provided having a terminal end at the first opening and a second gas supply tube having a terminal end at the second opening. A first igniter is mounted to the top surface adjacent the first opening and a second igniter is mounted to the top surface adjacent the second opening. A first burner is supported on the top surface having an inlet port for receiving gas from the first gas supply tube wherein the inlet port is off-set from the center point of the first burner. The first burner further has at least two igniter openings for receiving the first igniter such that the first burner may be rotated about the terminal end of the first gas supply tube and positioned in a plurality of positions wherein the first igniter is disposed in one of the at least two igniter openings. A second burner is supported on the top surface having an inlet port, off-set from the center point of the second burner, for receiving gas from the second gas supply tube. The second burner further has at least two igniter openings for receiving the second igniter such that the second burner may be rotated about the terminal end of the second gas supply tube and positioned in a plurality of positions wherein the second igniter is disposed in one of the at least two igniter openings. In this manner, the first burner and the second burner are both rotatable between a first position and a second position such that when the burners are in their respective first position they can be operated individually and in their respective second position they can be operated together to heat an elongated pan.

DESCRIPTION OF THE PREFERRED EMBODIMENT

Figure 1:
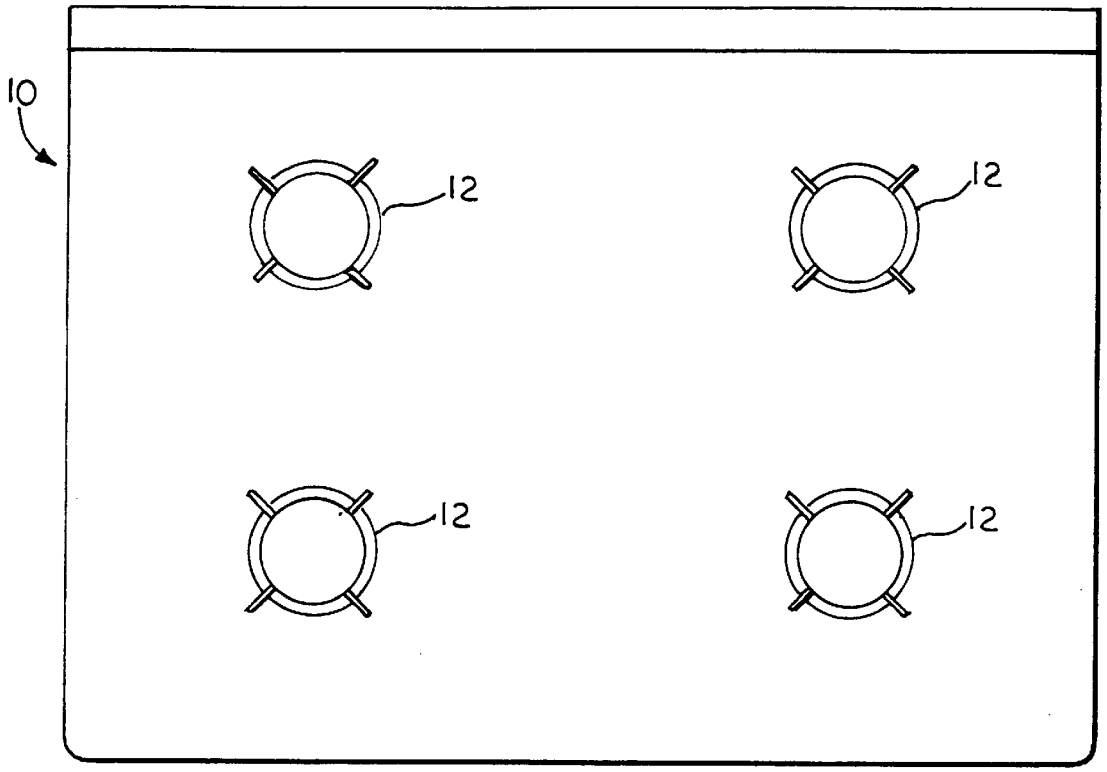
FIG. 1 PRIOR ART
FIG. 1 is a top view of a conventional cooktop or surface cooking unit showing a conventional burner arrangement.
Figure 2:
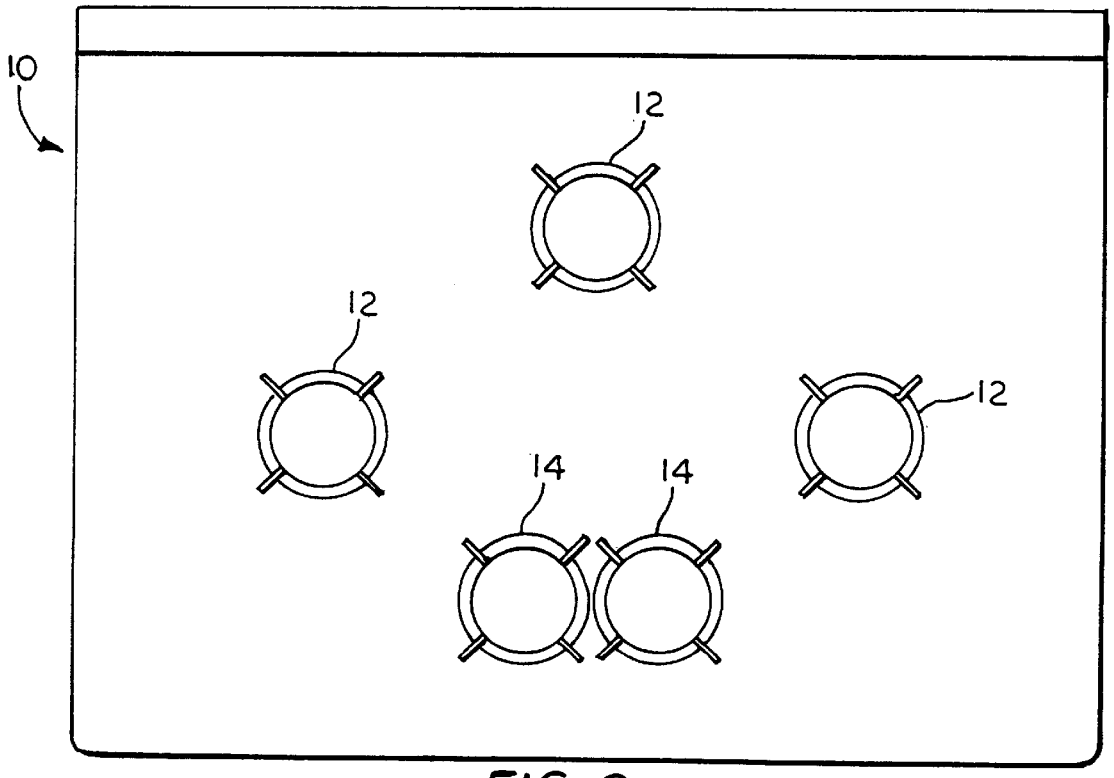
FIG. 2 PRIOR ART
FIG. 2 is a top view of a conventional cooktop or surface cooking unit showing another conventional burner arrangement.
Figure 3:
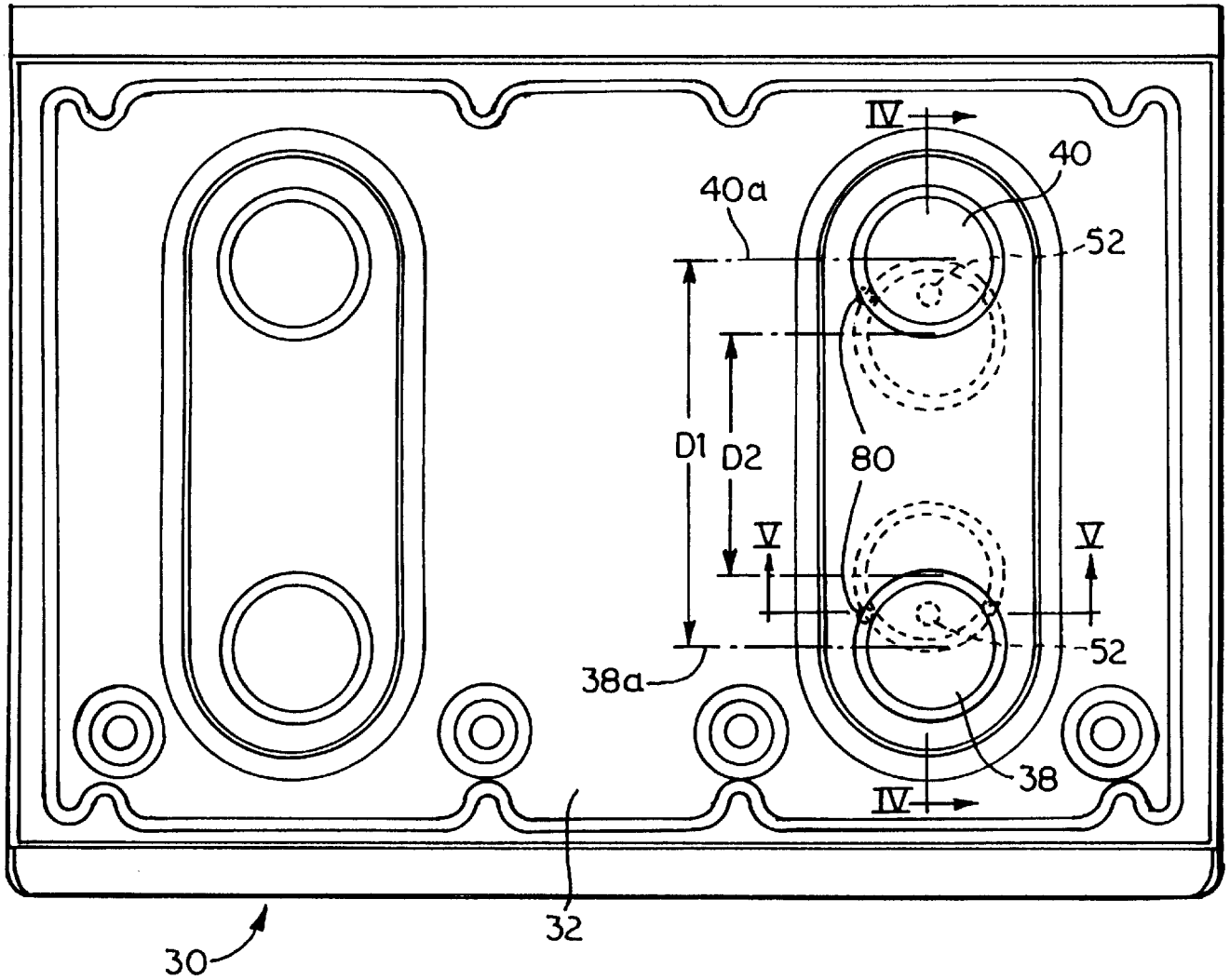
FIG. 3 is a top view of the surface cooking appliance illustrating the burner arrangement of the present invention.
Figure 4A:
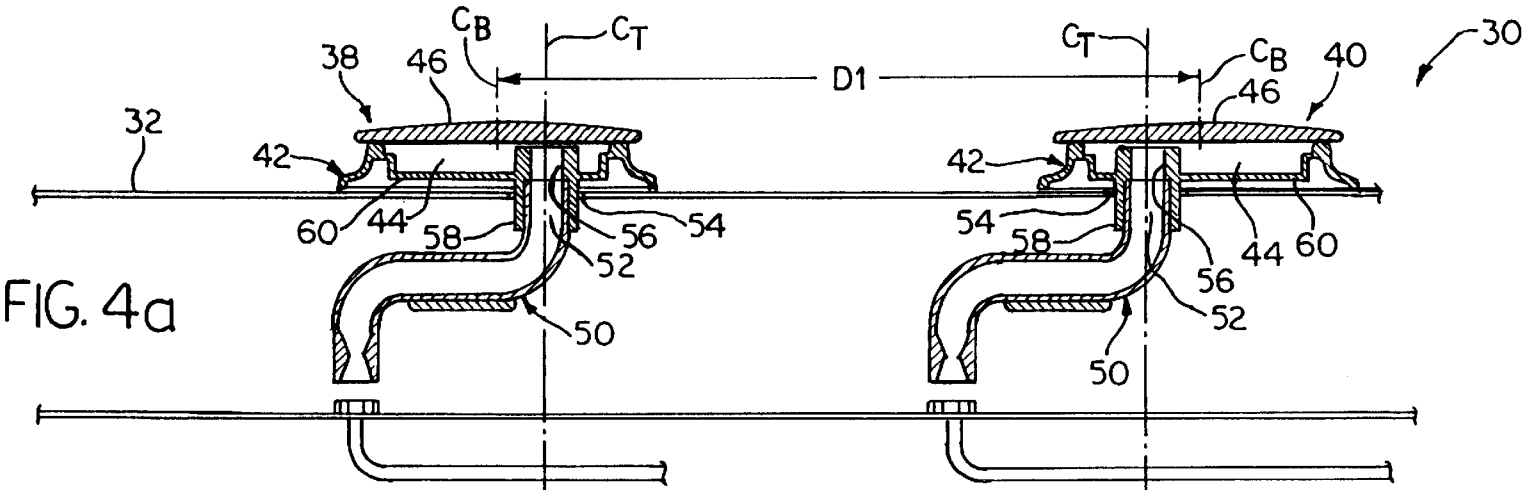
FIG. 4*a* is a side sectional view taken along line IV—IV in FIG. 3, illustrating the rotatable burners of the present invention in a first position.
Figure 4B:
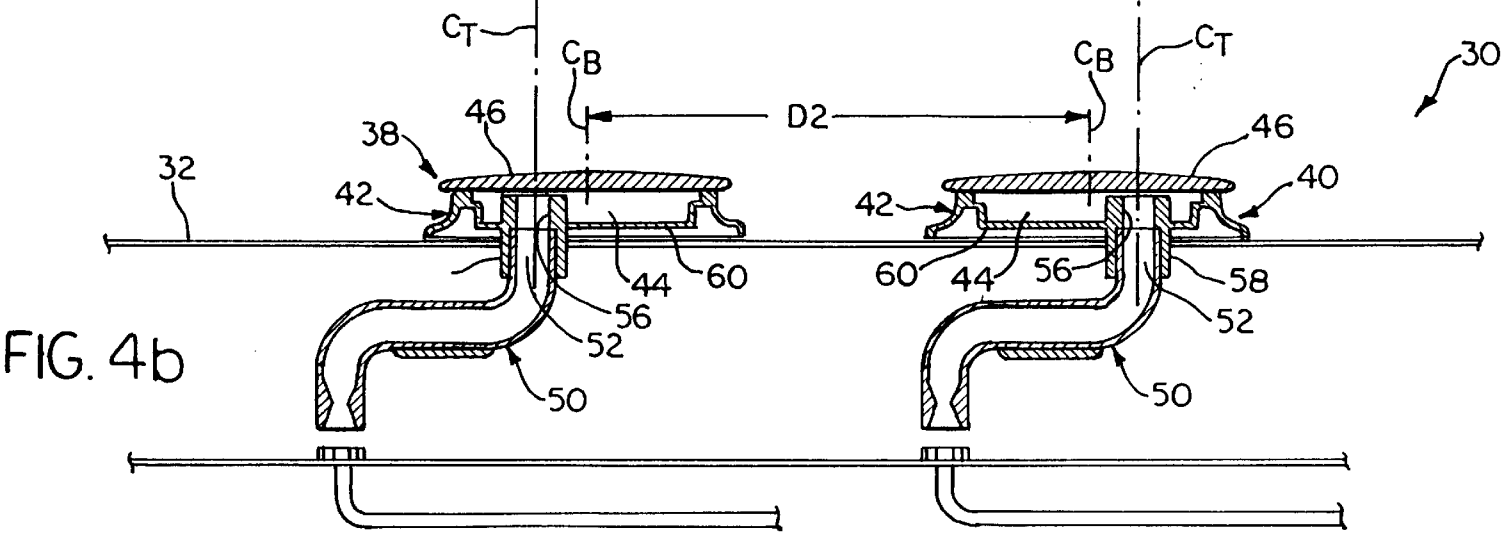
FIG. 4*b* is a side sectional view taken along line IV—IV in FIG. 3, illustrating the rotatable burners of the present invention in a second position.

Referring to FIGS. 3, 4*a* and 4*b*, there is shown a surface cooking device 30. The surface cooking device 30 may be mounted along the top of a freestanding range or may be mounted into a kitchen cabinet arrangement. The surface cooking device 30 includes a top panel 32. Provided on the top panel 32 are a plurality of burners including a first rotatable burner 38 and a second rotatable burner 40. The burners 38 and 40 are shown having centerlines 38*a* and 40*a* which extend through the center axis $C_B$ of the respective burners 38 40.. As provided by the present invention, burners 38 and 40 are movable such that in a first position, the distance between the centerlines 38*a* and 40*a* is a first distance D1 and in a second position, the distance between the centerlines is a second distance D2, less than the distance D1. In this manner, the burners can be located a distance D1 apart from each other for individual use and can be moved closer together, a distance D2 apart, such that the burners 38 and 40 can be effectively used together for heating an elongated pan, as will be further described hereinbelow.

Each of the burners 38 and 40 are constructed substantially identically and are therefore described together using the same reference numbers. Each burner 38 and 40 include a burner body 42 defining an internal chamber 44. A cap 46 is provided on the top of the burner body 42 for closing the internal chamber 44. The burners 38 40 are generally circular.

As shown in FIGS. 4*a* and 4*b*, gas is supplied to each of the burners 38 40 through tubes 50. These tubes 50 may be venturi tubes. The tubes 50 receive gas from an external supply which is regulated or controlled by valve means (not shown) which does not form part of this invention. As can be understood, the tubes 50 may be configured in any of a plurality of shapes and arrangements. For example, the tubes 50 may extend to the burners from a front, rear, side or bottom of the cooking device 30. However, each tube 50 will include an outlet end portion 52 which extends vertically upward toward an opening 54 in the top panel 32. The outlet end 52 may be secured by a bracket 53 (FIG. 5) attached to the top panel 32. In this manner, it can be understood that for each burner 38 and 40, there is an opening 54 in the top panel corresponding to an outlet end 52 of a gas supply tube 50. Each outlet end 52 of each gas supply tube 50 defines a center axis $C_T$.

Each burner body 42 includes an inlet port 56 through which gas passes from the tube 50 to enter the internal chamber 44. An annular fitting or sleeve 58 extends downwardly from a bottom wall 60 of the burner body 42 about the inlet port 56. The annular sleeve 58 is sized to receive the outlet end 52 of the tube 50. Gas is supplied into the internal chamber 44 of the burner via the interconnection between the tube 50 and the sleeve 58. For each of the burners 38 and 40, the inlet port 56 and corresponding annular sleeve 58 are located off center from the center axis $C_B$ of the burner. For each burner 38 and 40, therefore, when the burner is connected to its respective outlet end 52, the center axis $C_B$ of the burner is offset from the center axis $C_T$ of the corresponding outlet end 52 of the tube 50. Accordingly, it can be understood that the center points $C_B$ of the burners 38, 40 can be moved relative to each other by rotating the burners 38, 40 about the outlet ends 52 through which gas is supplied into the burners.

FIGS. 4*a* and 4*b* illustrates two different positions in which the burners 38, 40 can be positioned by rotating the burners 38, 40 about their respective outlet ends 52. In FIG. 4*a*, the burners 38, 40 are positioned in the first position wherein the distance between the respective center axes $C_B$ of the burners 38 and 40 (corresponding to the centerlines 38*a* and 40*a* shown in FIG. 3) is the first distance D1. In FIG. 4*b*, the burners 38, 40 are rotated about the center axes $C_T$ of the corresponding outlet ends 52 of the tube 50 such that the burners 38, 40 are positioned in the second position wherein the distance between the respective center points $C_B$ of the burners 38 and 40 (corresponding to the centerlines 38*a* and 40*a*) is the second distance D2. The difference between the first distance D1 and the second distance D2 is equal to twice the distance between the center point $C_T$ of the outlet ends 52 of the tube 50 and the center point $C_B$ of one of the burners 38, 40.

Figure 5:
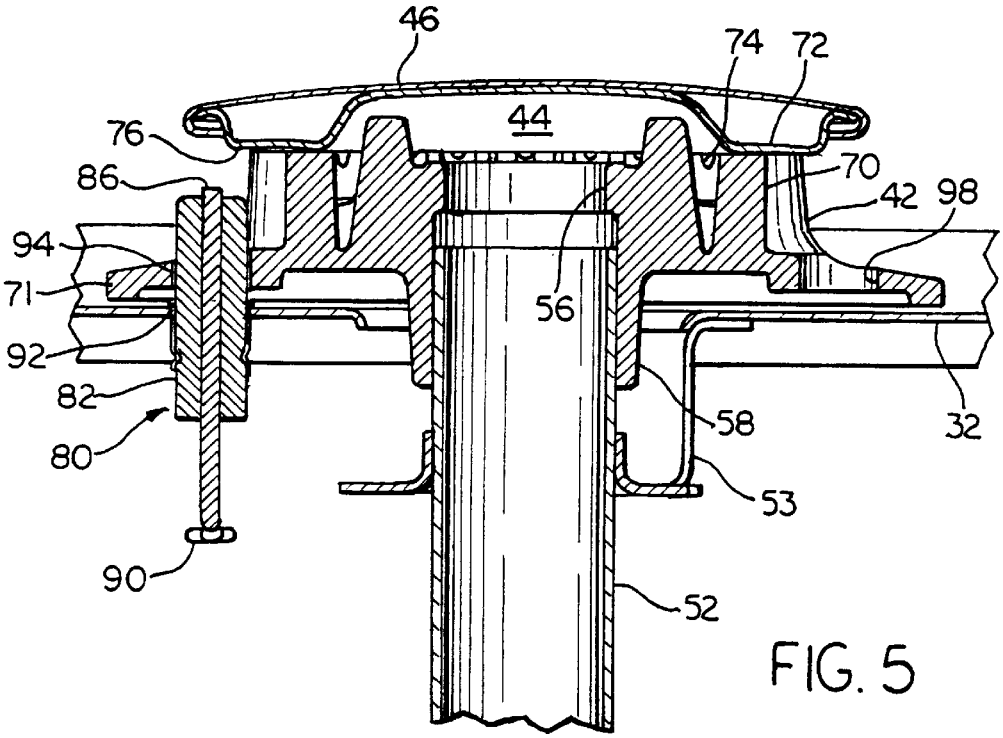
FIG. 5 is a side sectional view through a burner of the present invention taken along line V—V in FIG. 3.
Figure 6:
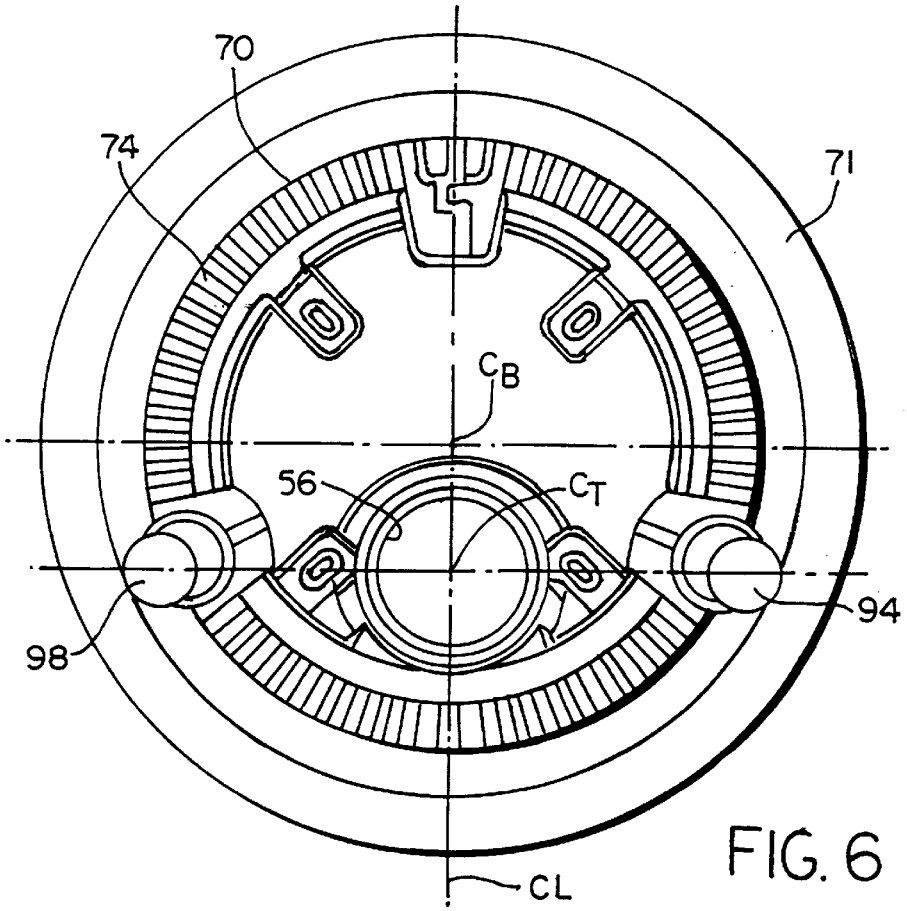
FIG. 6 is a top view of a burner of the present invention showing the burner body with the cap removed.

Turning now to FIGS. 5 and 6, further details of the burner system of the present invention are shown. Since the burner 38 and the burner 40 are substantially identical, reference is only made to the first rotatable burner 38. It can be appreciated, however, that the description of the burner 38 applies equally to the second burner 40. The burner body 42 includes an annular wall 70 extending upwardly from an annular bottom wall or flange 71. The annular wall 70 is provided with an annular substantially flat top surface 72 interrupted by a plurality of radially disposed and spaced apart U-shaped groves 74 disposed in a circular array pattern. The grooves 74 are adapted to be closed at the open ends by a substantially flat annular surface 76 formed on the bottom side of the cap 46 when the cap is positioned on top of the burner body 42. In this manner, the grooves 74 define port means through which fuel can issue to burn externally to the burner in a manner well known to the art.

Ignition of gas or fuel issuing from one or more of the grooves 74 is accomplished by an igniter assembly or igniter 80. The igniter assembly 80 may include an insulating body member 82 surrounding a conductive rod 84 forming an electrode. The conductive rod 84 has a top end 86 and a bottom end 88. Terminal means 90 extend from the bottom end 88 such that an electrical lead may be connected to the conductive rod 84. Sparking to cause ignition of fuel issuing from the burner 38 40, may be accomplished by supplying power to the conductive rod 84.

As shown in FIG. 5, the igniter 80 is preferably positioned along the outer periphery of the burner 38 40, adjacent the annular wall 70. The igniter 80 extends through an opening 92 provided in the top panel 32 and through an aligned igniter opening or hole 94 provided through the bottom flange 71 of the burner body 42. In this manner the top end 86 of the conductive rod 84 is positioned adjacent the burner ports 74. A clip or bracket 96 engages the insulating body member 82 and secures the igniter 80 to the top panel 32. During assembly of the surface cooking device 30, the igniter 80 may be secured to the top panel 32 and then the burner 38 40 may be placed onto the top panel 32 such that the sleeve 58 receives the outlet end 52 and the igniter 80 extends through the igniter hole 94 provided on the bottom flange of the burner.

To allow for each of the burners 38 and 40 to rotate about their respective outlet ends 52, each of the burners 38 and 40 are provided with both the first igniter hole 94 and a second igniter hole 98. Referring to FIG. 6, the two igniter holes 94 and 98 may be symmetrically disposed about a center line CL which extends through the center axes $C_B$ and $C_T$ of the burners 38 40 and the outlet ends 52. In this manner, for each burner 38 and 40, the inlet port 56 and the igniter openings 94 and 98 are all located on a line which is off-set from the center axis of the burner. Accordingly, referring now only to burner 38 for clarity, when the burner 38 is in its first position, the igniter 80 is disposed in the first igniter opening 94. However, when the burner 38 is rotated 180° to its second position, moving it closer to the burner 40, the igniter 80 is positioned in the second igniter opening 98.

It can be understood, therefore, that the present invention provides for a burner assembly having at least two igniter holes such that the burner may be rotated between a plurality of positions. By providing two igniter holes symmetrically disposed about an inlet port which is offset from the center axis of the burner, the burner is rotatable 180° about the inlet port. When two such rotatable burners constructed as described above, are placed adjacent each other on a cook surface, there is provided a means for moving the burners relatively close to each other for combined use. Accordingly, the present invention provides a convenient and low cost system for using burners both individually and in a combined manner.

It can be seen, therefore, that the present invention provides a unique surface cooking appliance and more particularly a unique burner arrangement for a surface cooking appliance. Although the present invention has been described with reference to a specific embodiment, those of skill in the Art will recognize that changes may be made thereto without departing from the scope and spirit of the invention as set forth in the appended claims.

We claim:

1. A surface cooking appliance comprising:

a top surface having a first opening and a second opening;

a first gas supply tube having a terminal end adjacent the first opening;

a second gas supply tube having a terminal end adjacent the second opening;

a first igniter mounted to the top surface;

a second igniter mounted to the top surface;

a first burner supported on the top surface having an inlet port for receiving gas from the first gas supply tube, the inlet port being off-set from the center point of the first burner, the first burner further having at least two openings for receiving the first igniter such that the first burner may be rotated about the terminal end of the first gas supply tube and positioned in a plurality of positions wherein the first igniter is disposed in one of the at least two openings; and a second burner supported on the top surface having an inlet port for receiving gas from the second gas supply tube, the inlet port being off-set from the center point of the second burner, the second burner further having at least two openings for receiving the second igniter such that the second burner may be rotated about the terminal end of the second gas supply tube and positioned in a plurality of positions wherein the second igniter is disposed in one of the at least two openings.

2. The surface cooking appliance according to claim 1, further wherein the first burner and the second burner are both rotatable between a first position and a second position such that when the burners are in their respective first positions they can be operated individually and in their respective second positions they can be operated together to heat an elongated pan.

3. The surface cooking appliance according to claim 1, further wherein the first burner and the second burner are both rotatable between a first position and a second position such that when the burners are in their respective first positions they are located a first distance apart and when the burners are in their respective second positions they are located a second distance apart wherein the second distance is less than the first distance.

4. The surface cooking appliance according to claim 1, wherein for both the first and second burners the at least two openings for receiving the igniter are located along the periphery of the respective burner.

5. The surface cooking appliance according to claim 1, wherein for both the first and second burner:

the burner is substantially circular having a center axis;

the at least two openings for receiving the igniter are two openings located along the periphery of the burner;

the inlet port is located off-set from the center axis such that a center line passes through the center of the inlet port and the center axis of the burner, and the two openings are symmetrically disposed about the center line such that the burner is rotatable between two positions separated by 180° angular displacement.

6. A surface cooking appliance comprising:

a top surface having a first opening;

a gas supply tube having a terminal end adjacent the first opening;

a igniter mounted to the top surface; and a burner supported on the top surface having an inlet port for receiving gas from the gas supply tube, the inlet port being off-set from the center point of the burner, the burner further having at least two openings for receiving the igniter such that the burner may be rotated about the terminal end of the gas supply tube and positioned in a plurality of positions wherein the igniter is disposed in one of the at least two openings.

7. The surface cooking appliance according to claim 6, wherein the at least two openings for receiving the igniter are located along the periphery of the burner.

8. The surface cooking appliance according to claim 6, wherein:

the burner is substantially circular having a center axis;

the at least two openings for receiving the igniter are two openings located along the periphery of the burner;

the inlet port is located off-set from the center axis such that a center line passes through the center of the inlet port and the center axis of the burner, and the two openings are symmetrically disposed about the center line such that the burner is rotatable between two positions separated by 180° angular displacement.

9. A surface cooking appliance comprising:

a top surface having a first opening and a second opening;

a first gas supply tube having a terminal end adjacent the first opening;

a second gas supply tube having a terminal end adjacent the second opening;

a first igniter mounted to the top surface;

a second igniter mounted to the top surface;

a first burner supported on the top surface having a center point and a sleeve for engaging the first gas supply tube, the sleeve being off-set from the center point of the first burner, the first burner further having at least two openings for receiving the first igniter such that the first burner may be rotated about the terminal end of the first gas supply tube and positioned in a plurality of positions wherein the first igniter is disposed in one of the at least two openings; and a second burner supported on the top surface having a center point and a sleeve for engaging the second gas supply tube, the sleeve being off-set from the center point of the second burner, the second burner further having at least two openings for receiving the second igniter such that the second burner may be rotated about the terminal end of the second gas supply tube and positioned in a plurality of positions wherein the second igniter is disposed in one of the at least two openings.

10. The surface cooking appliance according to claim 9, further wherein the first burner and the second burner are both rotatable between a first position and a second position such that when the burners are in their respective first positions they can be operated individually and in their respective second positions they can be operated together to heat an elongated pan.

11. The surface cooking appliance according to claim 9, wherein for both the first and second burners the at least two openings for receiving the igniter are located along the periphery of the respective burner.

12. The surface cooking appliance according to claim 9, wherein for both the first and second burner:

the burner is substantially circular having a center axis;

the at least two openings for receiving the igniter are two openings located along the periphery of the burner;

the inlet port is located off-set from the center axis such that a center line passes through the center of the inlet port and the center axis of the burner, and the two openings are symmetrically disposed about the center line such that the burner is rotatable between two positions separated by 180° angular displacement.

* * * * *

UNITED STATES PATENT AND TRADEMARK OFFICE

CERTIFICATE OF CORRECTION

PATENT NO. : 6,017,211

DATED : January 25, 2000

INVENTOR(S) : Gort et al.

It is certified that error appears in the above-indentified patent and that said Letters Patent is hereby corrected as shown below:

Title page: Item #73 Assignee

Whirlpool Corporation, Benton Harbor, Mich. and
Vitromatic Comercial S.A. DE C.V., Monterrey, N.L.
Mexico Signed and Sealed this Twenty-second Day of May, 2001

*Attest:*

Nicholas P. Godici

NICHOLAS P. GODICI

*Attesting Officer*

*Acting Director of the United States Patent and Trademark Office*